United States Patent [19]

Kawasaki et al.

[11] Patent Number: 4,723,518

[45] Date of Patent: Feb. 9, 1988

[54] ALUMINUM ALLOY CYLINDER HEAD WITH VALVE SEAT FORMED INTEGRALLY BY COPPER ALLOY CLADDING LAYER AND UNDERLYING ALLOY LAYER

[75] Inventors: Minoru Kawasaki; Kazuhiko Mori; Soya Takagi; Katsuhiko Ueda, all of Toyota, Japan

[73] Assignee: Toyota Jidosha Kabushiki Kaisha, Aichi, Japan

[21] Appl. No.: 944,850

[22] Filed: Dec. 22, 1986

[30] Foreign Application Priority Data

Dec. 25, 1985 [JP] Japan ..... 60-296191

[51] Int. Cl.[4] ..... F01L 3/02

[52] U.S. Cl. ..... 123/188 S; 123/188 AA; 123/193 CH; 251/359; 251/368

[58] Field of Search ..... 123/188 S, 193 H, 193 CH, 123/188 AA; 251/359, 368

[56] References Cited

U.S. PATENT DOCUMENTS

| | | | |
|---|---|---|---|
| 1,507,293 | 9/1924 | Kettering et al. | 123/193 CH |
| 2,240,202 | 4/1941 | Anselmi | 123/188 S |
| 2,280,660 | 4/1942 | Newcomb | 123/193 CH |
| 2,399,468 | 4/1946 | Cole | 123/193 CH |
| 2,456,272 | 12/1948 | Gregory | 123/193 CH |
| 2,600,529 | 6/1952 | Gregory | 123/188 S |
| 2,881,750 | 4/1959 | Hanink | 123/188 AA |
| 3,773,504 | 11/1973 | Niimi et al. | 123/188 AA |
| 4,424,953 | 1/1984 | Takagi et al. | 251/368 |
| 4,505,988 | 3/1985 | Urano et al. | 251/359 |
| 4,671,491 | 6/1987 | Kuroishi et al. | 123/188 S |

FOREIGN PATENT DOCUMENTS

| | | | |
|---|---|---|---|
| 3206979 | 11/1982 | Fed. Rep. of Germany | 123/188 S |
| 55-8497 | 1/1980 | Japan . | |
| 57-171572 | 10/1982 | Japan . | |

OTHER PUBLICATIONS

SAE Technical Paper Series 850406, two pages.

*Primary Examiner*—Ira S. Lazarus
*Attorney, Agent, or Firm*—Parkhurst & Oliff

[57] ABSTRACT

This internal combustion engine cylinder head includes a main portion made substantially from aluminum alloy and having a valve port which has a circumferential valve seat surface for cooperation with a poppet valve to open and close communication through the valve port. A cladding layer is formed of copper alloy claddingly laid upon this valve seat surface, and an intermediate alloy layer is present between the copper alloy cladding layer and the main cylinder head portion, this intermediate alloy layer being composed essentially of an alloy between the aluminum alloy of the main cylinder head portion and the copper alloy of the cladding layer. Thereby, the anti-wear properties of the valve seat are desirably improved without making the fabrication process unduly troublesome or costly. The proportion of aluminum diffused into the copper alloy cladding layer from the main portion of the cylinder head should preferably be not more than about 15%. The thickness of the intermediate alloy layer should preferably be between about 5 microns and about 300 microns, and the thickness of the copper alloy cladding layer should preferably be at least about 50 microns. If "x" denotes the thickness of the intermediate alloy layer in microns, this thickness value being between about 5 and about 300, and if "y" denotes the thickness of the copper alloy cladding layer in mm, then preferably the relationship $y=1.5254x+42.373$ should at least approximately hold.

12 Claims, 9 Drawing Figures

ALUMINUM ALLOY CYLINDER HEAD WITH VALVE SEAT FORMED INTEGRALLY BY COPPER ALLOY CLADDING LAYER AND UNDERLYING ALLOY LAYER

BACKGROUND OF THE INVENTION

The present invention relates to a cylinder head for an internal combustion engine, and more particularly relates to such a cylinder head for an internal combustion engine for a vehicle such as an automobile, particularly which has a valve seat maunfactured integrally therein and endowed with exceptional wear resistance.

The present invention has been described in Japanese Patent Application Ser. No. Showa 60-296191 (1985), filed by an applicant the same as the applicant or the entity assigned or owed duty of assignment of the present patent application; and the present patent application hereby incorporates into itself by reference the text of said Japanese Patent Application and the claims and the drawings thereof; a copy is appended to the present application.

In the prior art, internal combustion engine cylinder heads have been often formed of aluminum alloys of various types, because of the advantages conferred upon such a material in view of its low weight and easy formability. However, the valve seat portions of such a cylinder head are very liable to wear, because they are repeatedly impacted by the intake or the exhaust poppet valves while the internal combustion engine is in operation, while simultaneously being exposed to extreme conditions of temperature and shock and gas abrasion and the like caused by the explosion of air-fuel mixture in the combustion chambers of the engine. As a result of this, in order to prevent excessive wear of and/or braking up and away of the valve seat portions of such a cylinder head made of aluminum alloy, due to friction and heat damage from frictional contact with the intake and the exhaust valves and with the products of combustion such as flaming gases, and also in order to limit dimensional changes of the valve seat portions due to thermal expansion caused by said hot combustion products, it has been in the past practiced to form a recess in the valve seat portion of the cylinder head by valve seat grinding or the like, and to insert, for example by cold pressing, into this recess a ring shaped valve seat insert made of cast iron or iron based sintered material.

However, in such a conventional type of cylinder head with pressed in insert valve seat, there is the problem that it is quite common for a thermal air insulation layer to be formed between the pressed in valve seat and the material of the cylinder head, and as a result of this, when under the operating conditions of the internal combustion engine the cylinder head and the valve seat are exposed to extremely high temperature, the transmission of heat from the valve seat to the cylinder head can be substantially obstructed by this thermal air insulation layer. As a result of this, the valve seat is liable to become unduly hot, particularly at particular portions thereof corresponding to points at which said thermal air insulation layer is thicker than at other points thereof—for the thermal air insulation layer is typically not of the same thickness all around the valve seat. In such a case, deterioration of various operational characteristics, including deterioration of the wear resistance of the valve seat, are liable to occur.

Furthermore, since the coefficent of thermal expansion and the coefficient of thermal conduction of such cast iron or sintered iron based material of which the valve seat is typically made are very different from the corresponding coefficients relating to the aluminum alloy of which the main body of the cylinder head is made, thereby, when the valve seat is pressed into the cylinder head itself, in view of these differences in thermal conductivity and thermal expansion, very high dimensional accuracy of the valve seat and of the recess in the cylinder head for receiving it become crucially important, and thus complicated and painstaking machining processes come to be required. This inevitably entails high cost.

A further problem that is encountered is that it is necessary to determine the strength and the dimensions of the portion of the cylinder head itself which receives the valve seat to be sufficient to reliably hold the valve seat when said valve seat is pressed into said cylinder head portion, and therefore the diameter of the valve seat and the diameters of the intake and the exhaust poppet valves come to be restricted, and it is in such a case difficult to increase the cooling efficiency of the cooling system for the cylinder head by making the coolant passages within said cylinder head very closely approach the valve seats and the combustion chambers. Thus, it becomes difficult to provide high performance of the internal combustion engine.

In order to resolve the above outlined problems with regard to forming the valve seat portions in a conventional cylinder head, methods of alloying which may be considered applicable to the formation of a valve seat portion of a cylinder head have been described in Japanese Patent Laying Open Publications Ser. Nos. 55-8497 (1980) and 57-171572 (1982), neither of which is it intended hereby to admit as prior art to the present patent application except to the extent in any case required by applicable law. In these methods, there is disclosed the concept whereby the surface portion of a metal sample made of a base metal material is melted by the use of a high energy source, an alloying material is added to this melted base metal surface portion, and then the melted and alloy portion is rapidly cooled down by absorption of heat by the other portions of the sample, whereby an alloy layer is formed on the surface of the base metal portion, comprising the base metal material and the alloy material alloyed therewith. Furthermore, in SAE Technical Paper Series 850406 there is described an internal combustion engine cylinder head in which a valve seat surface is defined by using such a local surface alloying method.

When the above type of alloying method is applied to the formation of a valve seat portion of a cylinder head which is made of aluminum alloy, all of the alloying material is melted into the aluminum alloy base material, and therefore a layer of substantially only the alloying material is definitely not formed on the surface of the alloy layer which is formed. Thus, the surface layer of the valve seat is in fact an aluminum alloy of a different composition from the aluminum alloy which makes up the main body of the cylinder head, but which is manufactured therefrom by alloying thereto the added alloying material. As a result of this, it is difficult satisfactorily to improve the wear resistance characteristics and so on of the valve seat. Again, when elements such as silicon and nickel and so on are added as alloying materials in order to improve the wear resistance and the heat resistance and so on of the valve seat, primary crystalline silicon and metallic compounds such as nickel-aluminum are formed, and these come to be distributed finely throughout the alloy layer. Such primary crystalline silicon and metallic compounds such as nickel-aluminum have good heat resistance, but, since the basic composition of the surface of the valve seat is inevitably that of an aluminum alloy material, if such a valve seat is exposed to a relatively high temperature such as about 150° C. for at least about 100 hours continuously, then the strength, the heat resistance, and the like of the valve seat surface will inevitably be severely deteriorated and in the worst case the valve seat will completely fail. Thus, such an aluminum alloy layer type valve seat surface is not durable enough for practical use in an internal combustion engine. If, in order to improve the heat resistance, the amount of the above described primary crystalline silicon and metallic compound such as nickel-aluminum is increased, then although such distributed materials have good heat resistance, since their toughness is extremely small and is in fact close to zero, a hard but extremely brittle alloy layer is formed as the valve seat surface. In an alloy layer thus formed, the problem arises that cracks may have already occurred after the formation thereof and even before the use thereof, and therefore such an alloy layer, although it can be described and conceived of from a theoretical standpoint, is not a practically useful material.

Also, with an alloying type surface preparation method such as described above for a valve seat surface for a cylinder head of an internal combustion engine, the rate of cooling of the alloy layer decreases in order from the interface with the main body portion of the cylinder head, the interior of the alloy layer, and the surface of the alloy layer, and it is not possible to ensure a uniform rate of cooling for all portions of the alloy layer, as a result of which it is difficult to obtain a uniform composition of the alloy layer, and in particular it is difficult to make the wear resistance of the surface of the alloy layer high, and therefore in the formation of the valve seat portion of the cylinder head a thick alloy layer is formed, and it is necessary in practice to apply a machining process with a relatively high process cost to the surface of the alloy layer.

SUMMARY OF THE INVENTION

The inventors of the present invention have considered the various problems detailed above in the conventional case of a pressed in valve seat insert portion being utilized for a cylinder head, and also in the case of applying a surface alloying method to the portion of such a cylinder head which is to constitute a valve seat portion thereof, from the point of view of the desirability of improving the working effectiveness and the quality and durability of the resulting cylinder head.

Accordingly, it is the primary object of the present invention to provide an internal combustion engine cylinder head, which avoids the problems detailed above.

It is a further object of the present invention to provide such an internal combustion engine cylinder head, which, in order to provide a good quality valve seat portion for an intake or an exhaust poppet valve, does not require any insert portions to be manufactured or inserted into any recesses thereof.

It is a further object of the present invention to provide such an internal combustion engine cylinder head, which provides good heat transmission characteristics for a valve seat portion thereof.

It is a further object of the present invention to provide such an internal combustion engine cylinder head, which keeps the equilibrium or operating temperature of a valve seat portion thereof relatively low.

It is a further object of the present invention to provide such an internal combustion engine cylinder head, a valve seat portion of which has relatively superior heat resistance characteristics.

It is a further object of the present invention to provide such an internal combustion engine cylinder head, a valve seat portion of which has relatively superior wear resistance characteristics.

It is a yet further object of the present invention to provide such an internal combustion engine cylinder head, which minimizes cost.

It is a yet further object of the present invention to provide such an internal combustion engine cylinder head, which minimizes the amount of accurate machining required during manufacture.

It is yet further object of the present invention to provide such an internal combustion engine cylinder head, which allows for the valves fitted therein to be made as large as practicable.

It is a yet further object of the present invention to provide such an internal combustion engine cylinder head, which allows for the cooling of the valves fitted therein to be as good as practicable.

It is a yet further object of the present invention to provide such an internal combustion engine cylinder head, which allows for the cooling of the combustion chamber defined therein to be as good as practicable.

It is a yet further object of the present invention to provide such an internal combustion engine cylinder head, which is compact and light in weight.

It is a yet further object of the present invention to provide such an internal combustion engine cylinder head, which provides good performance for the internal combustion engine incorporating it.

According to the most general aspect of the present invention, these and other objects are attained by a cylinder head for an internal combustion engine including a poppet valve, comprising: a main portion made substantially from aluminum alloy and generally formed with a valve port which has a circumferential valve seat surface for cooperation with said poppet valve to open and close communication through said valve port; a cladding layer formed of copper alloy claddingly laid upon said circumferential valve seat surface; and an intermediate alloy layer between said copper alloy cladding layer and said main portion of said cylinder head, composed essentially of an alloy of said alluminum alloy of said main portion of said cylinder head and said copper alloy of said copper alloy cladding layer.

According to such an internal combustion engine cylinder head as specified above, since the valve seat surface is defined by a cladding layer of copper alloy which is cladded on the aluminum alloy base material of the cylinder head, since the thermal conduction rate of copper alloy is high compared with that of cast iron or the like and moreover the cladded layer is continuous with the base cylinder head material via the alloy larger, as a result heat received by the valve seat portion is conducted effectively to the base cylinder head material, and thereby, when the internal combustion engine is operating, the final or equilibrium operating temperature of the valve seat portion is reduced, as compared with a conventional pressed in type of valve seat for a cylinder head. Therefore, by choosing as the copper alloy to form the cladding layer an alloy whose composition has superior wear resistance characteristics, the wear resistance characteristics of the valve seat surface can be improved.

Since, moreover, the valve seat surface is defined by the cladding layer, and is not defined by any alloy layer in which is present a large quantity of aluminium from the base cylinder head material as in the case where the valve seat portion is formed by an alloying method, thereby the basic composition of the cladding layer is the composition of a copper alloy having the desired characteristics of wear resistance and so forth or in a composition close thereto, and therefore, by comparison with the previously described case in which the cylinder head valve seat portion is formed by an alloying method, the durability of the cylinder head can be greatly improved.

Since furthermore an alloy layer is present between the cladding layer and the base cylinder head material, and the cladding layer and the base cylinder head material are integrated through this alloy layer, therefore, as compared with the case of a conventional pressed in valve seat type cylinder head or with the case in which the valve seat portion is formed as an alloy layer without any cladding layer being provided, the integrated nature of the valve seat portion with respect to other portions of the cylinder head is remarkably improved.

Since furthermore the total thickness of the cladding layer and of the alloy layer may be less than that of a valve seat which is pressed in, and since there is no requirement to provide any recessed portion around the valve seat for receiving any separate valve seat member, the diameter of the intake or the exhaust valve for the internal combustion engine can be increased, and it is possible for the coolant passages in the cylinder head to be made as passing closer to the valve seat portions of the cylinder head and to the combustion chambers thereof, whereby relatively higher performance of the internal combustion engine can be obtained.

Since furthermore it is not necessary, as in the contrasting case of a pressed in valve seat type cylinder head, to manufacture a valve seat member in a material other than aluminium alloy with high accuracy, nor is it necessary to form any recess in the cylinder head itself to accept such a valve seat member with high accuracy, nor it is required to fix any such valve seat member to the cylinder head itself by any complicated pressing operation, thereby the cost of the cylinder head can be beneficially reduced.

It has been discovered, according to various experimental researches conducted by the present inventors as will be particularly described later, that, as the dilution amount from the base aluminum alloy material of the cylinder head into the cladding layer material which is the copper alloy material increases, various characteristics of the cladding layer, and particularly the wear resistance thereof, are deteriorated, and further the number of blow holes therein increases. Therefore, according to a particular specialization of the present invention, the above and other objects may more particularly be accomplished by such an internal combustion engine cylinder head as first specified above, wherein the percentage proportion of aluminum diffused into said copper alloy cladding layer from said main portion of said cylinder head is not more than about 15%. Now, according to the results of the experimental researches carried out by the present inventors as will be described hereinafter, as the thickness of the alloy layer increases, the percentage dilution of aluminium from the base cylinder head material into the cladding layer increases; while, on the other hand, if the thickness of said alloy layer is too little, the cladding layer tends to become detached from the base cylinder head material, and durability is deteriorated. Also, further according to the result of experimental research carried out by the inventors of the present application, a substantially linear relationship holds between the percentage dilution of aluminium from the base cylinder head material into the cladding layer and the thickness of the alloy layer, and it has been confirmed that if the thickness of the alloy layer exceeds 300 microns then the dilution amount of the aluminium alloy base metal into the cladding layer will be higher than about 15%. Therefore, according to another detailed characteristic of the present invention, the thickness of the alloy layer is preferably set to be between about 5 and about 300 microns, and even more preferably is set to be between about 10 and about 260 microns. In this case, whereas with regard to the cladding process itself it is relatively difficult to set and control the cladding conditions so that a priori the aluminium dilution amount is definitely not more than 15%, it is on the other hand relatively easy to control the thickness of the alloy layer to be within the above ranges.

Furthermore, according to results of experimental research carried out by the inventors of the present application, as also described in more detail below, if the thickness of the cladding layer is too small, when the internal combustion engine has been operating for a long time, the cladding layer is liable to become worn away, and in such a case the alloy layer will be exposed to the valve seat surface, and as a result the wear resistance of the valve seat surface will be drastically reduced and early failure of the internal combustion engine as a whole will likely ensure. Therefore, according to yet another detailed characteristic of the present invention, the thickness of the cladding layer is set to be as least about 50 microns, and preferably is set to be at least about 200 microns.

Furthermore, according to results of the experimental researches carried out by the inventors of the present application as described in more detail below, the thickness of the required cladding layer depends on the thickness of the alloy layer, and increases as the thickness of the alloy layer increases. Therefore according to yet another detailed characteristic of the present invention, denoting by "x" the thickness of said intermediate alloy layer in microns, said thickness x in microns being between about 5 and about 300, and denoting by "y" the thickness of said copper alloy cladding layer in mm, the following relationship holds at least approximately: $y=1.5254x+42.373$.

If the thickness of the cladding layer is excessive, there will be no problems with the characteristics thereof, but some of the relatively expensive copper alloy will have been wasted, and the energy required for the clading process will have been increased. Therefore, according to yet another detailed characteristic of the present invention, the thickness of the copper alloy cladding layer is set to be not more than about 700 microns, and even more preferably is set to be not more than about 500 microns.

The copper alloy for forming the cladding layer may be any copper alloy which is capable of cladding on an aluminium alloy matrix material and which has good resistance to wear, good resistance to heat, and good resistance to corrosion, and this copper alloy cladding material is preferably an alloy of copper, nickel and iron, such as: a copper alloy with a composition of about 15.0% nickel, and about 3.0% iron, about 1.0% phosphorus, and remainder substantially copper; a copper alloy with a composition of about 20.0% nickel, about 4.5% iron, about 1.0% phosphorus, and remainder substantailly copper; or a copper alloy with a composition of about 25.0% nickel, about 2.5% iron, about 1.0% phosphorus, and remainder substantially copper. Further, as a method of cladding the copper alloy on the aluminium alloy matrix material, any cladding method may be performed, such as one using a high intensity energy source such as a laser, a TIG arc, or an electron beam, but particularly the cladding method disclosed in Japanese Patent Application Sho 60-157622 (1985), being an application by an applicant the same as the applicant of or the entity assigned or owed duty of assignment of the present patent application, is considered to be suitable; however, it is not intended hereby to admit this document as prior art to the present patent application, except to the extent in any case required by applicable law.

It should be noted that in this specification all percentages are percentages by weight, and all measurements are given in units of the metric system.

BRIEF DESCRIPTION OF THE DRAWINGS

The present invention will now be described with respect to the preferred embodiments of the device and of the method thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and flow chart steps and so on in the various figures relating to one preferred embodiment, and like parts and gaps and spaces and flow chart steps and so on in figures relating to different preferred embodiments; and:

DESCRIPTION OF THE PREFERRED EMBODIMENTS

The present invention will now be described with reference to various preferred embodiments thereof, and with reference to the figures.

Figure 1:
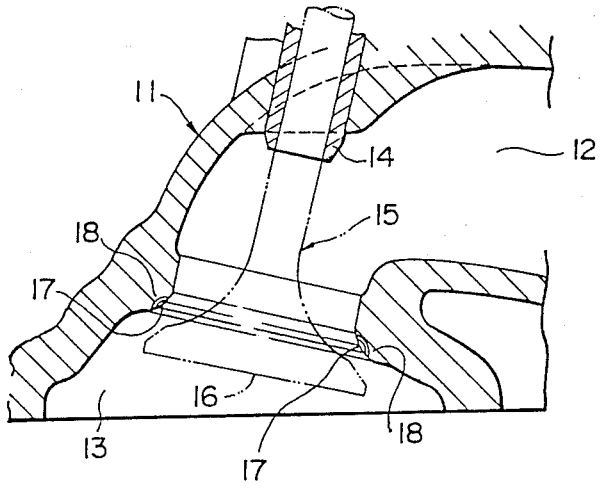
FIG. 1 is a partial longitudinal sectional view of an intake side portion of any one of the preferred embodiments of the internal combustion engine cylinder head of the present invention.

In the first preferred embodiment of the internal combustion engine cylinder head of the present invention, an intake side portion of which is shown in partial longitudinal cross sectional view in FIG. 1, the reference numeral 11 denotes the cylinder head as a whole, while 12 denotes an intake port formed in this cylinder head 11 and 13 is a combustion chamber depression defined on a surface of said cylinder head 11 which is adapted for being mated with a cylinder block, not particularly shown in any of the figures, so as to define a combustion chamber to which said intake port 12 opens. In fact, of course, typically this cylinder head 11 is formed with several such combustion chamber depressions 13 and so on, and defines several such combustion chambers; however, only one set of such arrangements is shown in the figures. And each said combustion chamber is formed with an exhaust side portion which is formed with an exhaust port; again, none of these arrangements are particularly shown. Through an upper portion of the defining wall surface of the intake port 12 there is fitted a valve guide 14, and in this valve guide 14 there is slidably fitted an intake valve 15 which is a poppet valve having a valve head 16 which is generally disk shaped and has a conical frustum shaped valve head mating surface formed on its annular peripheral edge portion. Corresponding to this, the cylinder head 11 is formed at its portion where the intake port 12 opens into the combustion chamber depression 13 with a valve seat portion 18 which is shaped with a conical frustum shaped valve seat surface 17. Thus, when the intake valve 15 is displaced downwards with respect to the valve guide 14 as shown in FIG. 1, its valve head mating surface is displaced away from the valve seat surface 17 of the cylinder head 11, thus leaving an ample gap for the passage of intake gases from the intake port 12 into the engine combustion chamber defined by the combustion chamber depression 13; but, when on the other hand said intake valve 15 is displaced downwards with respect to said valve guide 14 as shown in FIG. 1, its said valve head mating surface is pressed against said valve seat surface 17 of said cylinder head 11 and closely cooperates therewith, thus completely closing said gap therebetween and positively preventing any passage of intake gases from said intake port 12 into said engine combustion chamber or in the reverse direction, thereby sealing said combustion chamber for the combustive explosion of combustion gases therein. So far the construction is per se conventional.

Figure 2:
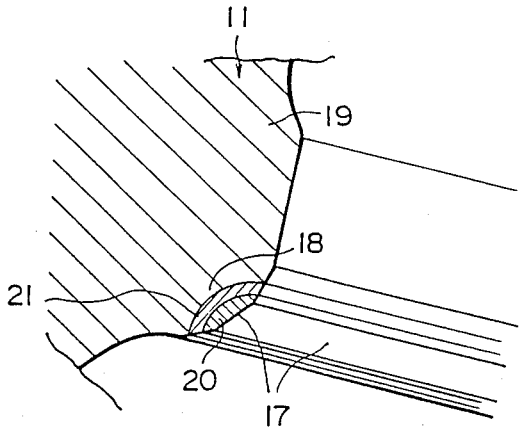
FIG. 2 is an enlarged view of a portion of the sectional view of FIG. 1, particularly showing a cross section of the valve seat portion of said preferred embodiment internal combustion engine cylinder head.

In FIG. 2 there is shown an enlarged view of a portion of the sectional view of FIG. 1, particularly showing a cross section of the valve seat portion 18 of this preferred embodiment internal combustion engine cylinder head, and of its valve seat surface 17. In detail, the main body 19 of the cylinder head is made of aluminum alloy of a per se known type, and the valve seat surface 17 is defined by being formed on a copper alloy cladding layer 20 of copper alloy material which is claddingly laid, as will be described shortly hereinafter, on an appropriate part of the portion of said cylinder head 11 where the intake port 12 opens into the combustion chamber depression 13. And, between the main aluminum alloy body portion 19 of the cylinder head 11 and the copper alloy cladding layer 20, there is also formed, as also will be defined shortly, an intermediate layer 21 of alloy material produced by alloyingly mixing the elements of the aluminum alloy which composes the cylinder head 11 and the copper alloy which composes the copper alloy cladding layer 20. And the main aluminum alloy body portion 19 of the cylinder head, the intermediate alloy layer 21, and the copper alloy cladding layer 20 are in fact integral and continuous with one another, actually blending into one another without any such discontinuous boundaries being defined as are shown in FIG. 2 for the purposes of illustrative explanation only.

For reasons which will be described in detail hereinafter, the dilution amount of aluminum alloy from the main aluminum alloy body portion 19 of the cylinder head into the copper alloy cladding layer 20 is restricted to be not more than about 15%, the thickness of the intermediate alloy layer 21 is required to be in the range of from about 5 to about 300 microns, and the thickness of the copper alloy cladding layer 20 is required to be at least 50 microns.

WORKING EXAMPLE

Now, a particular working example of the preferred invention, which constitutes a preferred embodiment thereof, will be explained.

Figure 3:
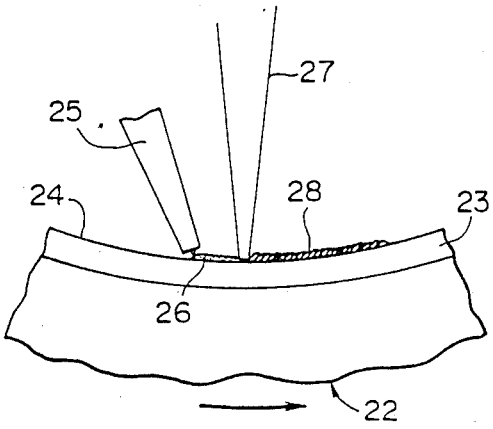
FIG. 3 is a schematic part sectional view showing the process of producing said valve seat portion of said preferred embodiment internal combustion engine cylinder head, using a $CO_2$ laser.

First, a cylinder head rough casting denoted as 22 was formed from an aluminum alloy material of JIS standard AC2C, having nominal composition of from about 2.0% to about 4.0% copper, from about 5.0% to about 7.0% silicon, from about 0.2% to about 0.4% magnesium, not more than about 0.5% zinc, not more than about 0.5% iron, from about 0.2% to about 0.4% manganese, not more than about 0.35% nickel, not more than about 0.2% titanium, not more than about 0.2% lead, not more than about 0.1% tin, not more than about 0.2% chromium, and remainder substantially aluminum. Next, as shown in FIG. 3 in schematic sectional view, the cylinder head rough casting work piece 22 was rotated as a unit around the central axis of the portion 23 thereof which was to constitute the valve seat portion 18 in the finished product (i.e. was rotated around the central axis of the hole formed for the valve guide 14), and while this was being done the surface 24 thereof which corresonded to the valve seat surface 17 of the finished product was steadily supplied from a powder supply nozzle 25 with a layer 26 of powder of a copper alloy, composition about 15.0% nickel, from about 3.0% iron, from about 1.0% phosphorus, and remained substantially copper, with the assistance of an assist gas flow, and this laid down copper alloy powder layer 26 was carried into the path of and was irradiated by the beam 27 of a $CO_2$ laser which followed behind said powder supply nozzle 25 and was oscillated rapidly to and fro in a direction perpendicular to the drawing paper in FIG. 3 (i.e. transverse to the direction of advancement of the process), so that said copper alloy powder layer 26 was thereby melted along with a portion of the substrate aluminum alloy material of the cylinder head rough casting work piece 22 on which said copper alloy powder layer 26 rested, to subsequently congeal in the wake of the $CO_2$ laser beam 27 as a cladding layer 28 (which corresponds to the copper alloy cladding layer 20 of FIG. 2) with an intermediate alloy layer 21 lying underneath it which is not shown in FIG. 3, said intermediate alloy layer 21 being composed of a mixture of the copper alloy material of said copper alloy cladding layer 20 and the aluminum alloy material of which the cylinder head rough casting work piece 22 was made. In this exemplary implementation: the laser output was about 2.0 Kw; the output mode was multi mode; the laser beam diameter was about 1.0 mm; the assist gas was argon gas and had a flow rate of about 0.5 $kg/cm^2$ by 10 liters/minute; the thickness of the copper alloy powder layer 26 was about 1.0 mm; the rate of advancement of the process (i.e. the peripheral speed of the valve seat rough surface 24) was about 300 mm/minute; the oscillation frequency of the laser beam 27 was about 150 Hz; and the width of said laser beam 27 was about 5 mm. Lastly, machine processing such as grinding was applied to the resultant work piece, to finally form a cylinder head with valve seat integrally formed therein such as shown in FIGS. 1 and 2.

Figure 4:
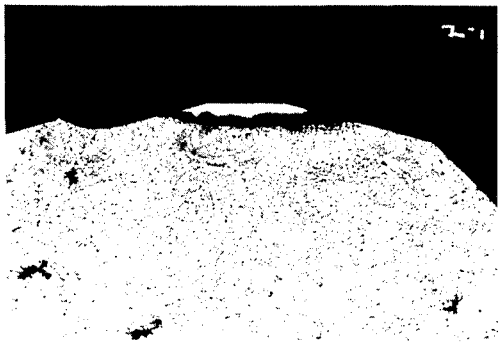
FIG. 4 is a longitudinal sectional photo micrograph taken at an enlargement of 10×, showing a section of said cylinder head valve seat portion and a portion of the adjoining substrate aluminum alloy cylinder head material.

FIG. 4 is a sectional photo micrograph taken at an enlargement of 10× in a longitudinal sectional plane which includes the central axis of the valve guide 14, showing the thus produced valve seat portion 18 of the cylinder head 11 along with an adjoining portion of the substrate aluminum alloy material of said cylinder head 11. The central horizontally extending line portion in FIG. 4 is the valve seat surface 17, and the white colored portion directly below that line is the copper alloy cladding layer 20; the black colored portion directly below said copper alloy 20 is the intermediate alloy layer 21 which is of relatively large crystalline structure, and below said intermediate alloy layer 21 there is the main aluminum alloy body portion 19 of the cylinder head which is speckled in color. As will be clear from this photo micrograph, substantially no blow holes or cracks or other defects are produced in the copper alloy cladding layer 20 or in the intermediate alloy layer 21.

By measurement, it was established that the thickness of the copper alloy cladding layer 20 was from about 100 microns to about 300 microns, the thickness of the intermediate alloy layer 21 was from about 50 microns to about 250 microns, and the average dilution amount of aluminum in said copper alloy cladding layer 20 was not more than about 10%.

In order to form an estimate of the characteristics of the cylinder head 11, hereinafter designated as "A", formed as described above, a bench durability test was carried out by using said cylinder head A in a test engine and running said test engine for about 200 hours at substantially full load at a rotational speed of approximately 6,500 rpm. The depression amount of the valve seat surface 17 of the valve seat portion 18, i.e. the change in the axial position of the intake valve 15 when in its closed position, was then measured, and was taken as being the amount of wear on said valve seat surface 17. Further, for the purpose of comparison, four similar tests were run using four comparison cylinder heads which were not embodiments of the present invention: a cylinder head hereinafter designated as "B", made of aluminum alloy of type ASTM standard A390 with nominal composition from about 16.0% to about 18.0% silicon, from about 4.0% to about 5.0% copper, not more than about 1.3% iron, from about 0.45% to about 0.65% magnesium, and remainder substantially aluminum, of which the valve seat portions were not specially prepared by any cladding or the like process and accordingly were not particularly differentiated from the main body of said cylinder head B; a cylinder head hereinafter designated as "C", made by pressing a valve seat formed of aluminum alloy of said type ASTM standard A390 into a cylinder head formed of another aluminum alloy of the type JIS standard AC2C described above; a cylinder head hereinafter designated as "D", made of aluminum alloy of said type ASTM standard A390, of which the valve seat portions were prepared by alloying, so that said valve seat portions were defined in an alloy layer of composition about 16.0% to about 18.0% silicon, not more than about 10% copper, not more than about 5.0% nickel, not more than about 1.3% iron, from about 0.45% to about 0.65% magnesium, and remainder substantially aluminum; and a cylinder head hereinafter designated as "E", made by pressing a valve seat formed of a sintered iron type material of composition about 10.0% to about 16.0% copper, from about 3.5% to about 8.0% lead, from about 3.0% to about 5.0% molybdenum, from about 0.05% to about 0.30% carbon, and remainder substantially iron, into a cylinder head formed of aluminum alloy of the type JIS standard AC2C described above. The results of these tests are shown in the graph of FIG. 5, in which elapsed test time in hours is shown along the horizontal axis and wear amount of the valve seats of the various above detailed cylinder heads is shown in mm along the vertical axis.

Figure 5:
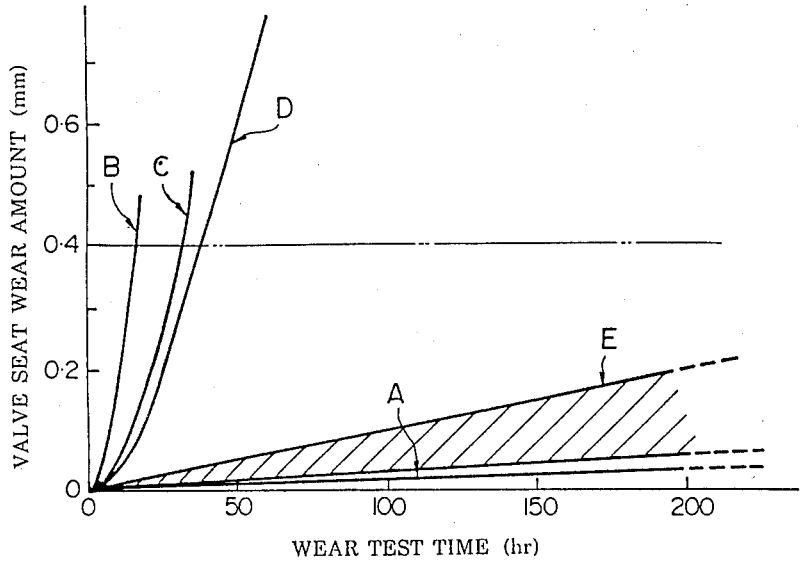
FIG. 5 is a graph relating to certain wear tests of a cylinder head according to the present invention and of four comparison cylinder heads, in which elapsed test time (in hours) is shown along the horizontal axis and wear amount of valve seats of said cylinder heads (in mm) is shown along the vertical axis.

From this FIG. 5 graph it will be understood that for all of the three comparison cylinder heads B through D the wear amount of the valve seat surface was extremely high within the short time after the start of the test. Furthermore, it will be seen that, in the case of the comparison cylinder head E which had a conventional type of pressed in valve seat made of a sintered iron type material, even after the full 200 hours of testing the wear amount on the valve seat was less than 0.4 mm, which is a typical amount that can be actually allowed for an internal combustion engine, but the wear amount of the cylinder head A which is a preferred embodiment of the present invention was substantially less even than said relatively acceptable wear amount of said comparison cylinder head E. Therefore, it is seen that the cylinder head A, being a preferred embodiment of the present invention, had overall superior characteristics as regarded wear performance, when compared with cylinder heads generally used conventionally.

Next, a discussion will be made of the appropriate range for the thickness of the intermediate alloy layer 21 and of how it is related to the dilution of aluminum alloy into the copper alloy cladding layer 20. By varying the processing conditions of the laser cladding process described above in various other tests which will not be described in detail herein in view of the desirability of conciseness of disclosure, various other test cylinder heads were produced, the thickness of the intermediate alloy layer 21 of the valve seat portions thereof being of various different values. In each case, the percentage of dilution of aluminum alloy into the material of the copper alloy cladding layer 20 was measured, along with the amount of blow holes in said copper alloy cladding layer 20 and said intermediate alloy layer 21 (measured as the number of blow holes per $cm^2$). Then, for each of these cylinder heads, a bench durability test carried out under substantially the same or similar conditions as in the case of the tests outlined above; and in each case the amount of wear (depression) on the valve seat portion was measured, substantially as before. The results of these tests are shown in FIG. 6, in which the thickness of the intermediate alloy layer 21 is shown along the horizontal axis and the valve seat portion wear amount, the blow hole count, and the percentage aluminum dilution into the cladding layer 20 are all shown along their own vertical axes.

Figure 6:
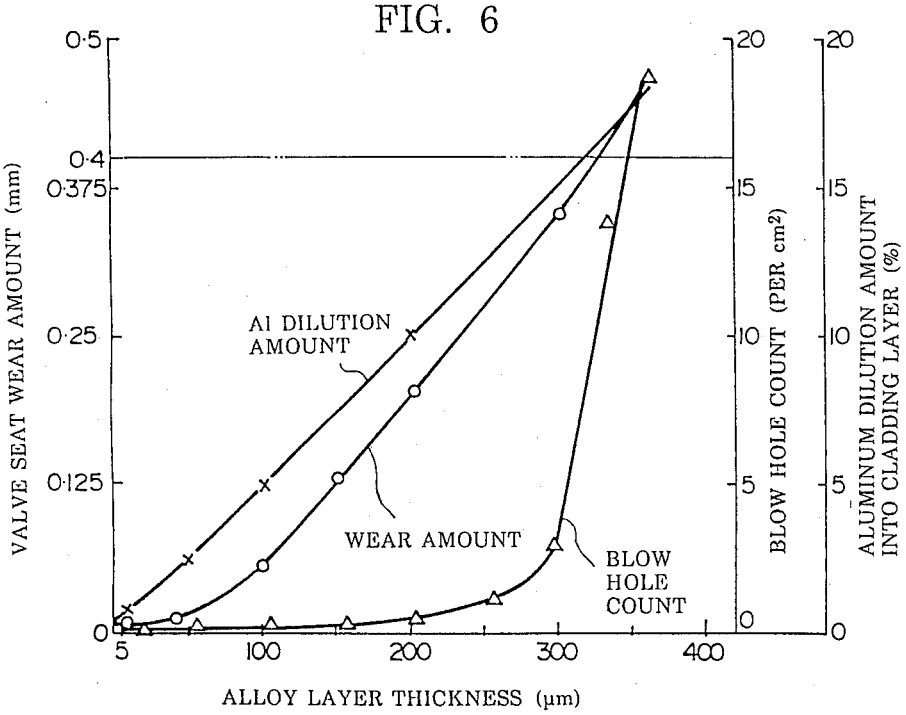
FIG. 6 is a graph relating to a first battery of such tests, in which the thickness of an intermediate alloy layer in microns is shown along the horizontal axis and valve seat wear amount (in mm), blow hole count (in counts/cm$^2$), and aluminum dilution into a cladding layer (in percent) are all shown along their own vertical axes.

Further, another battery of tests was run, substantially the same as the FIG. 6 tests, except in that as the copper alloy used for forming the copper alloy cladding layer 20 there was utilized a quantity of copper alloy having composition of about 25.0% nickel, about 2.5% iron, about 1.0% phosphorous, and balance substantially copper. The results of these tests are shown in FIG. 7, which is similar to FIG. 6 for the first battery of tests.

Figure 7:
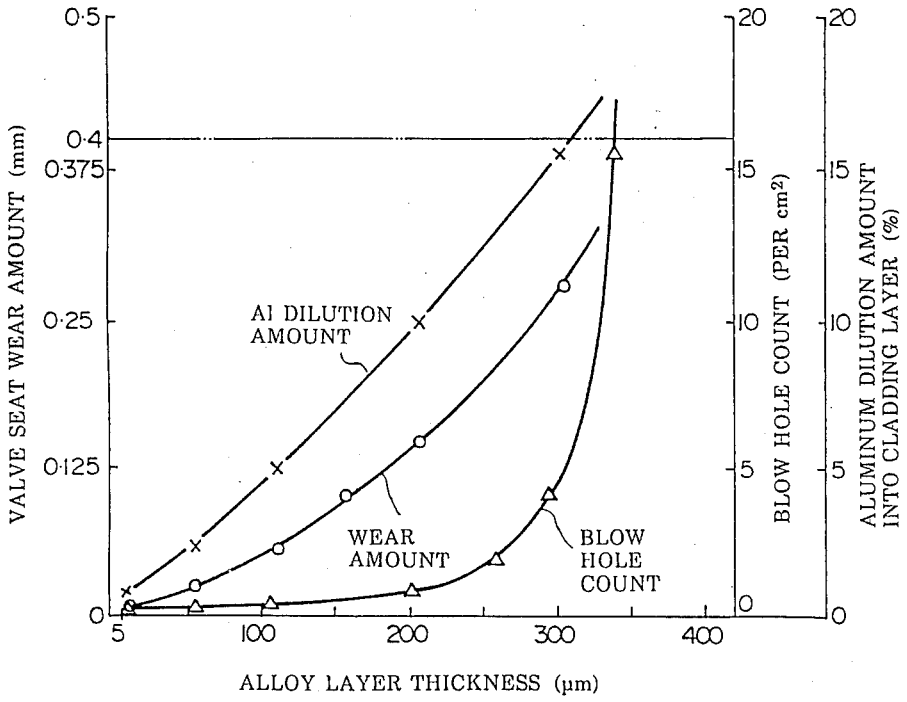
FIG. 7, which is similar to FIG. 6, is a graph relating to a second battery of such tests, in which again the thickness of said intermediate alloy layer in microns is shown along the horizontal axis and valve seat wear amount (in mm), blow hole count (in counts/cm$^2$), and aluminum dilution into said cladding layer (in percent) are all shown along their own vertical axes.

From FIGS. 6 and 7, it will be clear that there is a close relation between the percentage of dilution of aluminum alloy into the material of the copper alloy cladding layer 20 and the thickness of the intermediate alloy 21. When the thickness of the intermediate alloy layer 21 is relatively low, for instance in the case when said thickness is about 5 microns, the aluminum dilution amount into the copper alloy cladding layer 20 is approximately zero (i.e., is 0.5% or less), while as the thickness of said intermediate alloy layer 21 increases the aluminum dilution amount into the cladding layer increases substantially linearly in such a manner that, when the thickness of the intermediate alloy layer 21 is approximately 300 microns the aluminum dilution amount is approximately 15% or greater. It will also be seen that the amount of wear on the valve seat surface increases as the thickness of said intermediate alloy layer 21 increases, although the relationship is not linear in this case. Additionally, it will be seen that the number of blow holes is relatively small when the thickness of the alloy layer 21 is less than about 300 microns, and particularly is very reasonably small when said thickness of said alloy layer 21 is less than about 250 microns, but on the other hand increases rapidly when the thickness of said intermediate alloy layer 21 increases above about 300 microns. It will further be understood that, when the thickness of the alloy layer 21 is too small, the copper alloy cladding layer 20 tends to become detached from the main aluminum alloy body portion 19 of the cylinder head; and thus, in order to restrict the amount of depression of the valve seat portions of the cylinder head to a value of about 0.4 mm or less, which as explained above is a typical actually acceptable value in the case of such a bench durability test as described above, and for stable results of the valve seats during operation, it is desired that the thickness of the intermediate alloy layer 21 should be from about 5 microns to about 300 microns, and more preferably should be from about 10 microns to about 260 microns.

The reason for the amounts of depression of the valve seat portions of the cylinder heads in the FIG. 7 tests being substantially less than the corresponding amounts of depression of the valve seat portions of the cylinder heads of the FIG. 6 tests is surmised to be that, because the amount of nickel included in the copper alloy used to form the copper alloy cladding layer 20 is greater in the case of the FIG. 7 tests than in the FIG. 6 tests, the heat resistance of the copper alloy cladding layer 20 is thereby improved by this additional nickel.

Figure 8:
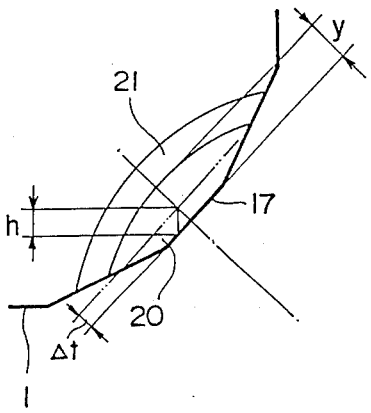
FIG. 8 is a schematic enlarged sectional diagram of the valve seat portion of the cylinder head shown in FIGS. 1 and 2, illustrating the relationship between thickness reduction amount of the copper alloy cladding layer, the amount of wear on the valve seat portion, and the thickness of the copper alloy cladding layer.
Figure 9:
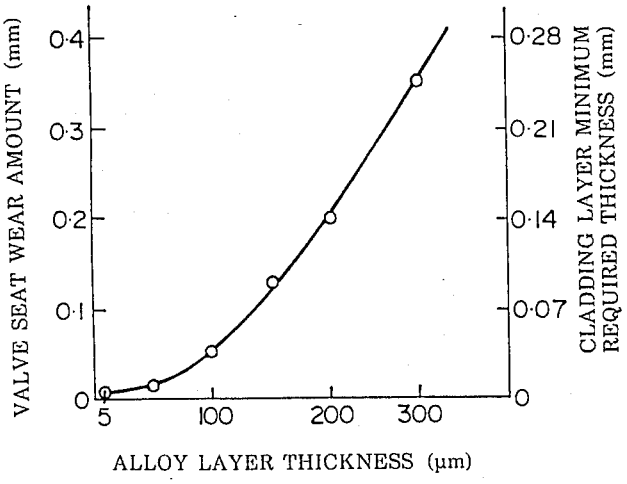
FIG. 9 is a graph, in which the thickness of said intermediate alloy layer in microns is shown along the horizontal axis and the valve seat portion wear amount (in mm) and the minimum required thickness for the cladding layer (also in mm) are shown along their own vertical axes.

Next, a discussion will be made of the minimum required thickness for the copper alloy cladding layer 20. FIG. 8 is a schematic enlarged sectional diagram of the valve seat portion shown in FIGS. 1 and 2, and illustrates the relationship between the thickness reduction amount denoted as "delta-t" of the copper alloy cladding layer 20 and the amount of wear (depression) on the valve seat portion, denoted as "h"; further, "y" denotes the thickness of the copper alloy cladding layer 20. And FIG. 9 is based upon the data of FIG. 6, and shows the thickness of the intermediate alloy layer 21 along the horizontal axis and the valve seat portion wear amount and the minimum required thickness for the cladding layer 20 along their own vertical axes.

Referring to FIG. 8, it will be seen that in this typical case the angle between the valve seat surface 17 and the axis of to and fro motion of the intake valve 15 is 45°, i.e. the semi angle of the cone defined by said valve seat surface 17 is 45°. Therefore, the relation between the amount of wear h on the valve seat surface 17 as defined above (the change in the closed axial position of the intake valve 15) and the reduction delta-t in the thickness of the copper alloy cladding layer 20 is that h is equal to delta-t multiplied by $2\frac{1}{2}$. Therefore, in the case of the FIG. 9 configuration, if it is for example the case that the thickness of the intermediate alloy layer 21 is 5 microns, the amount of wear h on the valve seat surface 17 is about 0.02 mm, and then in this case the minimum required thickness t for the copper alloy cladding layer 20 is given, approximately, by:

$$t=0.02/2\tfrac{1}{2}\text{ mm}=0.0141\text{ mm}=14.1\text{ microns}$$

It will therefore be seen that, in this first exemplary case that the thickness of the intermediate alloy layer 21 is about 5 microns, it may be adequate for the copper alloy cladding layer 20 to have thickness y equal to about 15 microns; but, in order to provide stability, said thickness y of said copper alloy cladding layer 20 should preferably be set to be at least about 50 microns. On the other hand, in the case that the thickness of the intermediate alloy layer 21 is about 300 microns, the amount of wear h on the valve seat surface 17 is about 0.35 mm, and then in this case the minimum required thickness t for the copper alloy cladding layer 20 is given, again approximately, by:

$$t=0.35/2\tfrac{1}{2}\text{ mm}=0.245\text{ mm}=245\text{ microns}$$

It will therefore be seen that, in this second exemplary case that the thickness of the intermediate alloy layer 21 is about 300 microns, it may be adequate for the copper alloy cladding layer 20 to have thickness y equal to about 250 microns; but, in order to provide stability, said thickness y of said copper alloy cladding layer 20 should preferably be set to be at least about 500 microns.

When, on the other hand, the thickness y of the intermediate alloy layer 21 is between about 5 microns and about 300 microns, then a proportionality equation may be applied to the cases above for which the thickness of said intermediate alloy layer 21 was about 5 microns and was about 300 microns, and thereby it can be determined that it is adequate and satisfactory, in other words is preferable, for the thickness y of the copper alloy cladding layer 20, in microns, to be approximately determined by the following equation, where "x" represents the thickness of the intermediate alloy layer 21:

$$y=1.5254x+42.373$$

CONCLUSION

Although the present invention has been shown and described in terms of the preferred embodiments thereof, and with reference to the appended drawings, it should not be considered as being particularly limited thereby, since the details of any particular embodiment or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow.

What is claimed is:

1. A cylinder head for an internal combustion engine including a poppet valve, comprising:

a main portion made substantially from aluminum alloy and generally formed with a valve port which has a circumferential valve seat surface for cooperation with said poppet valve to open and close communication through said valve port;

a cladding layer formed of copper alloy claddingly laid upon said circumferential valve seat surface; and an intermediate alloy layer between said copper alloy cladding layer and said main portion of said cylinder head, composed essentially of an alloy of said aluminum alloy of said main portion of said cylinder head and said copper alloy of said copper alloy cladding layer.

2. An internal combustion engine cylinder head according to claim 1, wherein the proportion of aluminum diffused into said copper alloy cladding layer from said main portion of said cylinder head is not more than about 15%.

3. An internal combustion engine cylinder head according to claim 1, wherein the thickness of said intermediate alloy layer is between about 5 microns and about 300 microns.

4. An internal combustion engine cylinder head according to claim 1, wherein the thickness of said intermediate alloy layer is between about 10 microns and about 260 microns.

5. An internal combustion engine cylinder head according to claim 1, wherein the thickness of said copper alloy cladding layer is at least about 50 microns.

6. An internal combustion engine cylinder head according to claim 1, wherein the thickness of said copper alloy cladding layer is at least about 200 microns.

7. An internal combustion engine cylinder head according to claim 1, wherein the thickness of said copper alloy cladding layer is less than about 700 microns.

8. An internal combustion engine cylinder head according to claim 1, wherein the thickness of said copper alloy cladding layer is less than about 500 microns.

9. An internal combustion engine cylinder head according to claim 1, wherein, denoting by "x" the thickness of said intermediate alloy layer in microns, said thickness x in microns being between about 5 and about 300, and denoting by "y" the thickness of said copper alloy cladding layer in mm, the following relationship holds at least approximately: $y=1.5254x+42.373$.

10. An internal combustion engine cylinder head according to claim 1, wherein the composition of said copper alloy cladding layer is: about 15.0% nickel, about 3.0% iron, about 1.0% phosphorus, and remainder substantially copper.

11. An internal combustion engine cylinder head according to claim 1, wherein the composition of said copper alloy cladding layer is: about 20.0% nickel, about 4.5% iron, about 1.0% phosphorus, and remainder substantially copper.

12. An internal combustion engine cylinder head according to claim 1, wherein the composition of said copper alloy cladding layer is: about 25.0% nickel, about 2.5% iron, about 1.0% phosphorus, and remainder substantially copper.

* * * * *